US007210422B1

(12) United States Patent
Hickok et al.

(10) Patent No.: US 7,210,422 B1
(45) Date of Patent: May 1, 2007

(54) FIN STABILIZER TO REDUCE ROLL FOR BOATS IN TURNS METHOD AND APPARATUS

(75) Inventors: William L. Hickok, Bellingham, WA (US); Mark R. Morgan, Lynden, WA (US); Richard M Benson, Ferndale, WA (US); Michael A. Baker, Burlington, WA (US)

(73) Assignee: Aluminum Chambered Boats LLC, Inc., Bellingham, WA (US)

( * ) Notice: Subject to any disclaimer, the term of this patent is extended or adjusted under 35 U.S.C. 154(b) by 55 days.

(21) Appl. No.: 10/796,472

(22) Filed: Mar. 8, 2004

Related U.S. Application Data

(60) Provisional application No. 60/452,710, filed on Mar. 7, 2003.

(51) Int. Cl.
*B63B 39/06* (2006.01)

(52) U.S. Cl. ..... 114/126; 114/152

(58) Field of Classification Search ..... 114/121–123, 114/126–143, 152, 283–285; D12/307, 309–314
See application file for complete search history.

(56) References Cited

U.S. PATENT DOCUMENTS

| | | | | | |
|---|---|---|---|---|---|
| 7,449 | A | * | 6/1850 | Andrews | 114/61.27 |
| 214,101 | A | * | 4/1879 | Clapham | 114/63 |
| 1,303,690 | A | | 5/1919 | Leparmentier | |
| 2,068,921 | A | * | 1/1937 | Leigh | 114/140 |
| 2,099,492 | A | * | 11/1937 | Luders | 114/285 |
| 2,171,686 | A | * | 9/1939 | Dawson | 114/140 |
| 2,560,153 | A | | 7/1951 | Blount | |
| 3,106,178 | A | * | 10/1963 | Cale | 114/284 |
| 3,140,686 | A | | 7/1964 | Olivotti | |
| 3,247,820 | A | * | 4/1966 | White | 114/280 |
| 3,261,038 | A | | 7/1966 | Klepper | |
| 3,470,839 | A | | 10/1969 | Faul et al. | |
| 3,473,502 | A | | 10/1969 | Wittkamp | |
| 3,982,493 | A | * | 9/1976 | Cronin | 114/144 R |
| 4,046,092 | A | | 9/1977 | Tornqvist | |
| 4,192,248 | A | | 3/1980 | Moyer | |
| 4,348,972 | A | | 9/1982 | Parsons | |
| 4,561,371 | A | | 12/1985 | Kelley et al. | |
| 4,627,372 | A | | 12/1986 | Douglas, III | |
| 4,667,618 | A | | 5/1987 | Cigognetti | |
| 4,781,136 | A | | 11/1988 | Van Der Velden | |
| D298,847 | S | * | 12/1988 | Raiter et al. | D12/307 |
| 5,078,072 | A | | 1/1992 | Horiuchi et al. | |
| 5,184,566 | A | | 2/1993 | Cochran | |

(Continued)

FOREIGN PATENT DOCUMENTS

| | | | |
|---|---|---|---|
| AU | 8034494 | A * | 6/1995 |

(Continued)

*Primary Examiner*—Ajay Vasudeva
(74) *Attorney, Agent, or Firm*—Michael F. Hughes; Hughes Law Firm, PLLC

(57) ABSTRACT

The invention relates to a fin stabilization system adapted to minimize roll about the longitudinal axis of the boat during sharp cornering at very high speeds. In one form, equipment such as a machine gun is mounted to the bow of the boat and targets are adapted to be engaged in high-speed maneuvers when cornering and the deck of the boat is not excessively rolled whereby blocking visibility in a turn.

46 Claims, 8 Drawing Sheets

U.S. PATENT DOCUMENTS

| | | | | |
|---|---|---|---|---|
| 5,261,345 | A | | 11/1993 | Fleming |
| 5,273,472 | A | | 12/1993 | Skedeleski et al. |
| 5,546,886 | A | | 8/1996 | Franceschelli et al. |
| 5,611,295 | A | | 3/1997 | Stables |
| 5,699,749 | A | | 12/1997 | Yamada et al. |
| 5,819,678 | A | * | 10/1998 | Austin ..... 114/126 |
| 6,024,042 | A | | 2/2000 | Eilert |
| 6,325,009 | B1 | | 12/2001 | Schulz et al. |
| 6,520,107 | B1 | | 2/2003 | Hickok |
| 6,546,884 | B1 | | 4/2003 | Rodriguez |
| 6,546,888 | B2 | | 4/2003 | Bertrand et al. |
| 6,807,920 | B1 | * | 10/2004 | Wynne ..... 114/284 |

FOREIGN PATENT DOCUMENTS

| | | | | |
|---|---|---|---|---|
| EP | 1300330 | A1 | * | 4/2003 |
| EP | 1435325 | A1 | * | 7/2004 |
| GB | 493373 | A | * | 10/1938 |
| GB | 2353976 | A | * | 3/2001 |
| JP | 56025090 | A | * | 3/1981 |
| JP | 05077780 | A | * | 3/1993 |
| JP | 2001233288 | A | * | 8/2001 |

* cited by examiner

FIG. 6

ENVIRONMENT

| FIN PARAMETERS | LENGTH | | WEIGHT | | CENTER OF GRAVITY | | SPEED | | HORSEPOWER | | DESIRED TURN RADIUS | | SPONSORS | | AERATED WATER | |
|---|---|---|---|---|---|---|---|---|---|---|---|---|---|---|---|---|
| | ▼ | ▲ | ▼ | ▲ | AFT | FWD | ▼ | ▲ | ▼ | ▲ | (▼ | ▲) | NO | YES | BAD | GOOD |
| "A" | ▼ ◀▶ | ▲ ◀▶ | ◀▶ | ◀▶ | ◀▶ | ◀▶ | ▼ | ▲ | | ◀▶ | ▲ | ▼ | | | ▲ | |
| "B" | ▼ | ▲ | ◀▶ | ◀▶ | ▼ | ▲ | ▲ | ▼ | | ◀▶ | ▼ | ▲ | | | | |
| "C" | ▼ | ▲ | ▼ | ▲ | ▼ | ▲ | ▲ | ▼ | | ▼ | ▼ | | ▼ | ▲ | ▼ | |
| "D" | ▼ | ▲ | ◀▶ | ◀▶ | | | | | | | | | | | | |

FIN STABILIZER TO REDUCE ROLL FOR BOATS IN TURNS METHOD AND APPARATUS

RELATED APPLICATIONS

This application claims priority benefit of U.S. Ser. No. 60/452,710, filed Mar. 7, 2003.

BACKGROUND OF THE INVENTION a) Field of the Invention

The present invention relates to stabilizing systems for boats, and more particularly for a stabilizing system which better enables boats to make sharp turns, and particularly sharp turns at relatively high speeds where the roll of the boat (rotation about the longitudinal axis of the boat) is minimized.

b) Background Art

When some boats having a shallow draft are making relatively sharp turns at high speeds, instability can be a problem. In some instances and with some configuration of boats (if not many configurations), when the rudder or the motor is turned as to execute a sharp turn, the boat will lean into the curve/roll, with the side of the boat on the inside of the curve moving downwardly into the water, and the opposite side on the outside of the boat being raised upwardly from the water. In this situation, it sometimes happens that the rear portion of the boat will slide or "skip" laterally, and then may tend to right itself with the boat tilting back the other way with the other side portion of the boat being lowered into the water. Not only does this create undesired instability, but it also does not permit proper execution of the sharp turn. The present invention is designed to alleviate that problem.

By way of pertinent background previous prior art design such as that known in U.S. Pat. No. 6,520,107, the boat a tendency to "heel over" whereby the boat rotates about its longitudinal axis into the direction of the turn. This is undesirable in a situation where the boat is desired to remain in a substantially planar position about the longitudinal axis and in a situation such as where a firearm is mounted in the bow portion of the watercraft where the term, "guns on target" is necessary to complete combat operations and maneuvers. For the disclosure of the present invention is well adapted to keep the boat flatter and less rotation about the longitudinal axis of the boat (roll) in the course of a turn, particularly where high lateral accelerations are exerted on the boat.

One prior art method of lifting the stern portion of the boat is to use trim tabs which are essentially vertically downward extending surfaces that extend into the water and provide a vertical lift in the aft portion of the boat to level it out. These are hydraulic trim tabs that are always placed on the stem of the boat. It has been found that the trim tabs are inadequate to prevent rotation about the longitudinal axis of the vessel in particularly in high G and sharp turns which is necessary in certain maneuvers such as military maneuvers. Trim tabs have been wholly inadequate to maintain a roll which is here in defined as rotation about the longitudinal axis of the boat.

Other known prior art includes U.S. Pat. No. 5,611,295 (Stables) where in the introductory portion of the patent (column 1), there is discussed the problem of "spin out" which is indicated as a problem of personal watercraft due to their more forward center of gravity. There is provided on each rear side portion of the boat a pair of inner and outer plates 10 and 11, each outer plate 10 having a length which can vary from eighteen to thirty inches. In column 2, line 34, it is indicated that the outer plate 10 will extend below the bottom edge of the hull 15 by approximately one inch, but it is indicated that the device is not necessarily limited to that dimension.

The operation of this apparatus is discussed on column 3, beginning on line 21. It is pointed out (beginning on line 28) that a unique feature of the outer plate 10 is its shape, and it is stated that this eliminates a detrimental reaction known as "sticking" in the aircraft industry. Beginning on line 34, it indicates that as the outer plate 10 moves laterally while in the turn, if it were perfectly rectangular, a low pressure area down the center of the plate would form, and thus the lower pressure area would create a suction that would stick the plate to the water. Then, when the boat is coming out of the turn and returning to a straight course, the craft must be over-steered to break the plate loose. This results in a brief period of loss of control. The patent indicates that the sides of the outer plate 10 are not parallel, and this discourages the "alignment" of any fluid circulation and reduces the formation of the pressure area. It can be seen in viewing FIGS. 1 and 4, that the upper and lower surfaces and the front and rear surfaces are non-parallel with one another.

Also in FIG. 5, the outer plate is positioned at the side of the boat and is aligned so that in a frontal view this plate slants downwardly and slightly inwardly toward the center of the boat. Thus, it would appear that as one side of the boat dips into the water making a sharp turn, this slant off the vertical would become more pronounced.

Additional patents show various sorts of plates or stabilizers that are mounted to the boat so as to protrude into the water.

U.S. Pat. No. 6,546,884 131 (Rodriquez) shows a "jet propelled watercraft stabilizing system." This shows what appear to be shaped more like fins that one would see commonly on a fish, with these fins protruding outward and downwardly from the rear side of the boat. In reading the patent, it would appear that the person steers the boat in large part by leaning to one side or the other and causing the fin to dip into the water. The angular position of the fins is adjustable and trim blocks are provided to accomplish the positioning of the fins at different angles.

U.S. Pat. No. 6,546,888 B2 (Bertrand et al.) shows stabilizing fins which are removably secured to either side of the small watercraft. FIG. 6 gives a rear view of the stabilizing fin, and it would appear to have more of an appearance of a right angle triangle with the hypotenuse of the triangle having a curve and one side of the triangle attaching to the boat.

U.S. Pat. No. 6,325,009 B1 (Schulz et al.) shows a sailboat having a dagger board that can be retracted or extended downwardly into the water on opposite sides of the boat to control side slip or leeway.

U.S. Pat. No. 5,273,472 (Skedeleski et al.) shows a flexible fin applied to the edges of a surf board for added stability.

U.S. Pat. No. 4,561,371 (Kelley et al.) shows a catamaran stabilizing structure where there is a stabilizing dagger board on each hull. The center board has a double-wing stabilizer with adjustable pitch.

U.S. Pat. No. 3,473,502 (Wittkamp) shows a pontoon boat with pontoons on opposite sides in something of a catamaran structure where there are keel-like elements, such as shown at 38, and one end of which is secured to the pontoon.

By way of general background it should be noted that when the boat is chinning the propeller portion of the motor is hitting "bad" or aerated water where the propellers are no longer in the higher viscous regions of regular water but in pure air or in air water mixture which has a lower density and lower counter force on the propeller causing an increase in the rpm's of the propellers. For example, when a propeller (or one of two propellers in a dual motor boat) is outside the water, it can reach very high rpm's (e.g. 6,000 rpm's). When this high velocity rotation reenters the water the momentum of the propeller as well as the applied torque from the motor can cause an abrupt acceleration thereby injuring the driver and passengers of the boat (such as breaking their tailbone and ribs). This is referred to as "chinwalking". Therefore it is advantageous to have the boat maintain a substantially minimal roll during a relatively sharp high-speed corner. In an environment such as a personal watercraft (i.e. a jet ski) this is not an issue because such watercraft are propelled by a jet propulsion hydraulic system, not a propeller which is most commonly used in a propeller driven system.

It should be noted that in the normal operations of boats, when engaging in a turn there is a de-acceleration and an excessive roll. For terms of definition, a certain degree of roll (i.e. 7–20 degrees) which in normal boating craft is sufficient and in some cases desirable because the net thrust with the lateral centrifugal force in gravity is substantially in line with the planar surfaces of the boat such as seats and standing areas. However, in recent times where certain combat operations necessitate a substantially lower amount of roll during turns, this excessive roll (i.e. 7–20 degrees with regard to the horizontal plane) is undesirable. Therefore even in prior art controlled turns where the velocity is lowered and the amount of roll is such that it exceeds 20 degrees, in a military or law enforcement type operation this is undesirable. It has been found in recent times that maintaining the roll of the boat to a minimum (e.g. 20–5 degrees), a gunner at the bow of the boat can maintain "guns on target" and engage a potential threat on the sea or the body of water. Further, it has been found that these turns can be engaged at full throttle and at full speed (e.g. 50 mph and at least 35–40 mph) where the roll of the boat is minimized and a wash out does not occur. The phenomena and apparatus to accomplish these goals are discussed further herein.

It should be noted that the term "guns on target" is in reference to maintaining a bead on a target during operational maneuvers. One of these maneuvers comprise high speed turns to port and starboard directions. For example, the vessel with a 50-callber machine gun mounted in the bow is making a port turn (i.e. to the left). In a prior art watercraft, the watercraft vessel will rotate into the turn where the starboard lateral portion will raise up with respect to the water thereby blocking visibility off the starboard bow and starboard side in general. This is clearly unacceptable if a potential target is located in this area. In many types of operations where such a turn is conducted, the driver may be avoiding a collision with a potential target whereby maintaining visibility and the ability to maintain a site picture is of a highest requirement.

It should further be noted that an excessive chinning or chine walking where the roll of the boat is so excessive that the propellers intermittedly engage causing intermittent thrust it is extremely undesirable in operations to have because this induces a lack of control where the boat is unstable and unsafe potentially causing injury to the driver and passengers. It should be noted that chinning is a roll where the boat rotates inwardly toward the turn. Chinning occurs where the boat rotates at the longitudinal axis inwardly in the direction of a turn and can have catastrophic effects where in some cases a boat will rotate and snap back to the opposite direction (where the outer lateral portion of the boat violently snaps downwardly) and cause bodily injury to the passengers and driver of the boat. Further, chinning or chine walking can compromise the boaters' abilities to engage in their missions such as firing a heavy machine gun, "bumping a boat" or maintaining a high speed pursuit.

It should be further noted that another benefit by implying the fin system is the vessel will track better at a lower velocity with respect to the water where the aft portion of the boat will not swing around or drift in a turn when subjected to the centrifugal forces of the turn. Therefore, essentially the vessel will go where it is intended without drifting in a low speed tracking where the rearward portion of the boat kicks outwardly away from the direction of the turn.

Therefore, it is a goal to stabilize the boat in corners to prevent chinning and roll in the course of a high G-force turn under full throttle in extreme maneuvers.

BRIEF DESCRIPTION OF THE DRAWINGS

FIG. 6 shows a qualitative graph showing general adjustments of the distance parameter of the fins with respect to various environment variables;

DETAILED DESCRIPTION OF THE PREFERRED EMBODIMENTS

As an introductory comment, the present invention is particularly adapted for use in a boat such as shown and described in the recently issued patent, U.S. Pat. No. 6,520,107 B1, with the inventor being one of the inventors as in the present application. The entire text and drawings of U.S. Pat. No. 6,520,107 B1 are hereby incorporated by reference.

Figure 5:
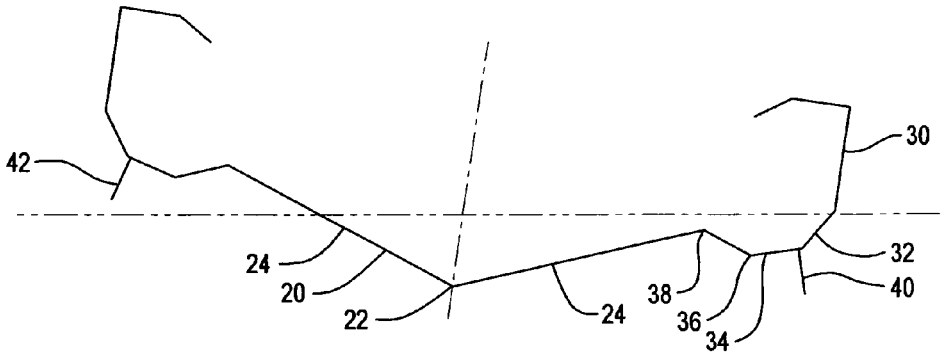
FIG. 5 is a schematic rear elevational view of the boat, drawn somewhat schematically and showing the boat executing a turn to the right, and also illustrating the operation of the present invention.

The boat 10 comprises a hull 12 having front and rear end portions 14 and 16, sidewalls 18, and a bottom wall 20. As can be seen in FIG. 5, in this particular configuration the bottom wall 20 is V-shaped so as to have a center keel 22 and two bottom wall sections 24 slanting upwardly and laterally outward at a moderate angle from the keel 22 at a moderate angle relative to the horizontal.

As is disclosed more completely in U.S. Pat. No. 6,520,107 131, the sidewall portions 18 are in this configuration made of aluminum sheets which have in cross-section a multi-creased configuration comprising planar portions 26 which connect to one another at creased locations 28. Thus, it can be seen in FIG. 6, that there is an outside substantially vertically aligned sidewall portion 30 which is connected at its lower end to a lower sidewall portion 32 which slants downwardly and inwardly at an angle of a little bit less than 45° to the horizontal, with this being in turn connected to a yet lower side wall portion 34 having a laterally outward creased connecting location 36 and an inner creased location 38.

The boat 10 which has been described thus far is, or may be, the same as shown in U.S. Pat. No. 6,520,107 131. The newly added features of the present invention will now be described, as these are used in connection with the boat described immediately above, with the understanding that these could also be used with other boat designs.

Figure 1:
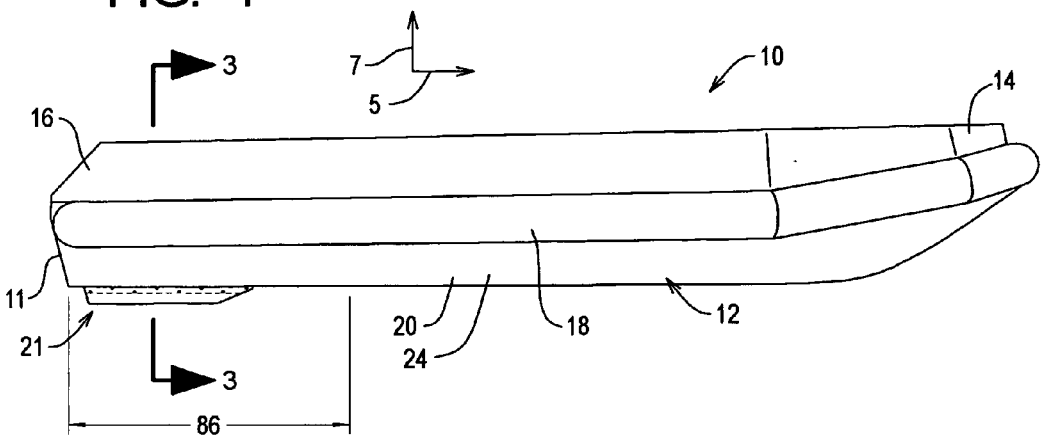
FIG. 1 is a side elevational view of a boat incorporating the stabilizing system of the present invention.
Figure 3:
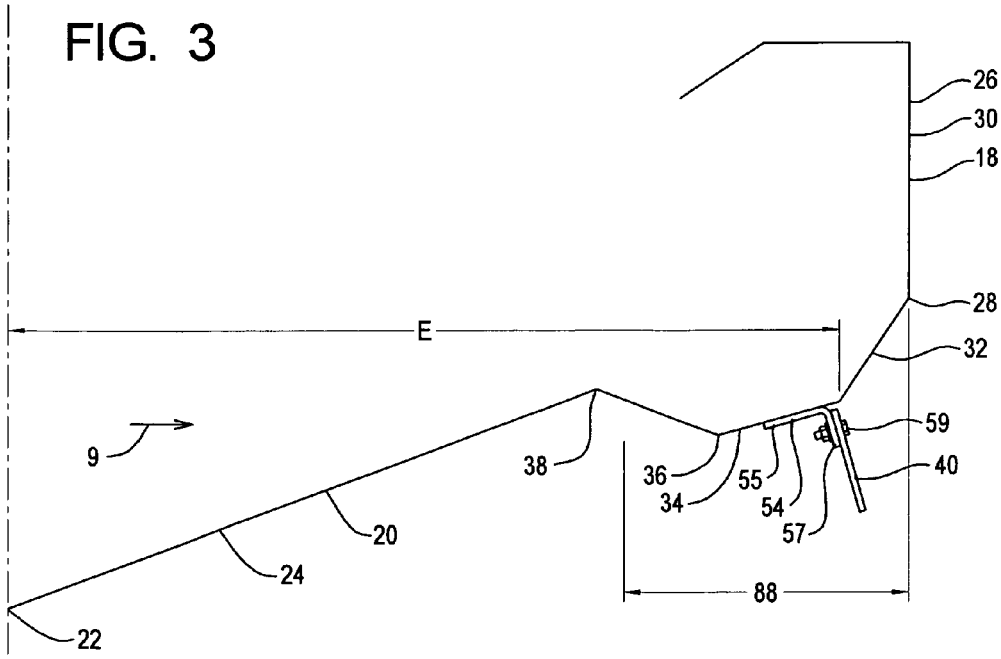
FIG. 3 is a sectional view taken along line 3—3 of FIG. 1, showing the turn control element attached to the lower starboard side of the boat.

To aid the description of the boat an axis system is defined where as shown in FIG. 1, the axis indicated at 5 shows a longitudinal forward direction and the axis indicated at 7 indicates a vertical direction. Further, as shown in FIG. 3 the axis indicated at 9 indicates a lateral direction. The boat 10 comprises a longitudinally rearward portion 11 which is defined as the end portion of the boat which is normally a region where the substantially horizontal surface of the hull transitions to a vertical surface which eventually extends out of the water.

Figure 2:
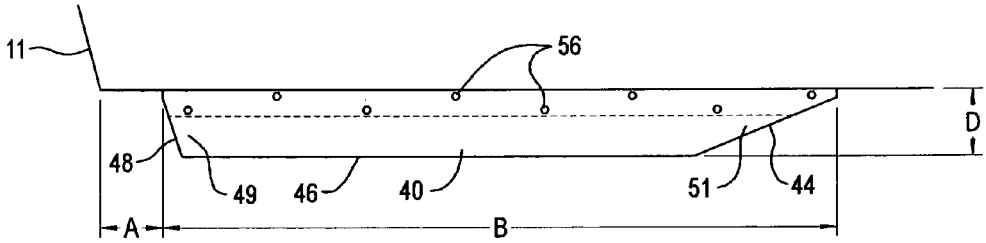
FIG. 2 is a view similar to FIG. 1, but drawn to an enlarged scale and looking only at the rear of the boat, to show one of the turn control elements in more detail.

There is installed a fin stabilization system 21 at the rear end of the boat that comprises right and left oppositely positioned fins or otherwise referred to as turn control elements 40 and 42 connected to the lower rear outer portions of the hull 12. Each turn control element 40 and 42 is in the form of a flat plate having a planar configuration. Each turn control element 40 and 42 has a downwardly and rearwardly sloping front edge 44, an elongate lower edge 46, and a rear edge 48 which is shown herein as nearly vertical but having a moderate upward and rearward slant. In this preferred embodiment, the total length dimension of each of the turn control elements 40 and 42 is indicated at B in FIG. 2, and is approximately four and one-half feet; however the dimension are further discussed herein. The vertical dimension of each element 40 and 42 is indicated at D, and is approximately one-half foot. Further, the dimension A. as shown in FIG. 2 is defined as the distance between the rear effective portion of the fins 40 and 42 and the longitudinally rearward portion 11 of the boat. It has been found that having this gapped region is advantageous to preventing aerated water from passing to the propeller of the boat during a high-speed turn. It should be noted that for purposes of this document, the rate of speed that is indicated for a turn is hereby defined as the rate for entering into a turn and for purposes of claim limitation, the rates for the speeds do not need to be maintained throughout the turn. In other words, a 35 mph turn is expressly defined as entering into the turn and 35 mph with the throttle on and the rate of this speed need not be maintained throughout the course of the turn but rather. As shown in FIG. 3, the dimension E is provided which measures the approximate lateral distance from the fins 40 and 42 from the center line of the boat. However, it is obvious that these dimensions could be changed depending on various factors described below, such as the size of the boat, the design of the boat, performance characteristics of the boat, adaptability to various boat configurations, and other factors.

As shown in FIG. 3, each of the turn control elements (i.e. first and second fins) 40 and 42 can be connected by suitable mechanical means, such as a right-angle bracket 54, which are connected at various bolt hole locations, as indicated at 56 in FIG. 2.

The bracket 54 comprises a base region 55 and an extension 57. In one form, the base region 55 is rigidly connected to the sidewall portion 34 by, for example, being welded thereto. The connectors 59 in one form are a nut and bolt arrangement. Although as shown in FIG. 3, the nuts and bolts extend laterally outside of the surfaces of the extension 57 and the fin 40, in one form either or both of the end sections of the connectors 59 are flush with the adjacent surfaces. This can be accomplished with recessed regions in the fin 40 and extension 57.

In this particular configuration, it can be seen that the alignment of the plane occupied by each of the turn control elements 40 and 42 is substantially perpendicular to its related adjacent bottom wall section 24. Thus, each of the turn control elements 40 and 42 have a downward and outward slant.

As shown in FIG. 2, the first and second fins 40 and 42 collectively comprise a fin stabilization system. The first and second fins 40 and 42 each comprise a rear effective portion 49 and a forward effective portion 51. These effective portions are defined as longitudinal regions where the first and second fin substantially begin and end. Other words, for purposes of describing the first and second fins 40 and 42, the effective portions relate to approximate distances where the vertical dimension is substantially such as to have a sufficient hydro-dynamic influence on the boat. For example, the vertically higher forward portion of the fins 40 and 42 could theoretically extend the lengthwise portion of the boat but be at a sufficiently low depth (e.g. less than ⅜ of an inch) to have any significant effect upon the turning characteristics of the boat. Therefore this thin depth portion would not be considered a part of the effective portions of the first and second fins 40 and 42. It should be noted that the distances A, B, and D are measured from the longitudinally rearward portion 11 of the boat, and the rearward and forward effective portions of the fins 40 and 42.

Figure 4:
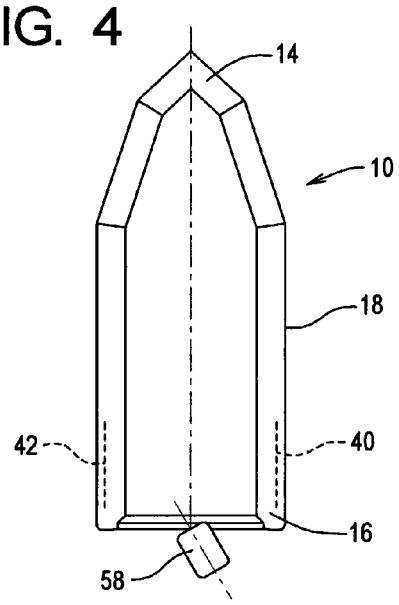
FIG. 4 is a top plan view showing the motor at the stern of the boat turned so as to turn the boat to the right.

To describe now the operation of the present invention, reference is made to FIGS. 4 and 5. It can be seen in FIG. 4 that there is a motor 58 (either an outboard motor or inboard/outboard motor) mounted to the stern of the boat, and in the orientation of FIG. 4, the rear end of the motor is slanted starboard (to the right) so as to execute a turn to the right. In executing this turn, the starboard side of the boat will tilt downwardly, as seen in FIG. 5, as the boat moves into the turn. When this occurs, it can be seen that the port side of the boat 10 lifts upwardly, and in this particular drawing of FIG. 5 actually moves out of the water. It should be noted that in one form two motors are employed and attached to the rearward portion of the boat. In this embodiment maintaining a substantially more level boat during a high-speed turn is desirable because each of the props are positioned in the greater laterally outward location. In this location the props are more susceptible to being exposed to aerated water as the laterally outward region of the boat raises.

Now, let us assume that the turn control elements 40 and 42 are not mounted to the boat. In this instance, when the boat 10 is going into the turn and in particular executing a rather sharp turn, as indicated earlier, there is a tendency for the rear end of the boat to "skip" out of the water. It can be surmised, by viewing FIG. 5, that this is due at least in part to the slanted left bottom wall section 24 slipping sideways and creating an upward force component tending to lift the rear of the boat up from the water, and the centrifugal force causing it to skip.

However, with the turn control elements 40 and 42 being installed, it can be seen that the right element 40 is positioned in the water, and this resists this lateral skipping of the rear end portion of the boat 10. With this side slippage of the rear end of the boat being in large part prevented, there is less lateral movement of the rear of the boat to the left, and the effective upward force exerted on the left bottom wall section 24 is substantially reduced. Thus, the combination of these applied forces enables the boat to make a much tighter turn and avoid the boat becoming unstable in the manner described above with respect to the prior art.

It is believed that the above explanation is at least a partial explanation of the various phenomena involved. However, there may be other factors which contribute to the performance advantages obtained by the present invention, and regardless of the accuracy of the explanation given above in this text, it has been found by actual experimental use that these turn control elements 40 and 42 do contribute to the performance of the boat 10 in making relatively sharp turns at high speed.

Figure 5A:
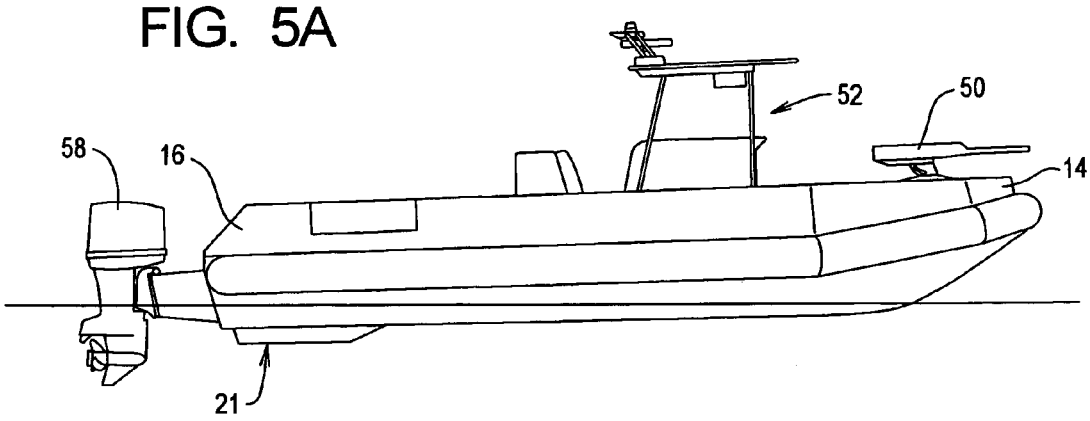
FIG. 5*a* shows a side elevation 12 of an example of implementing the apparatus of the present invention where a device such as a machine gun is mounted to the bow of the boat.

As shown in FIG. 5*a* located in the bow region of the boat there is a mounted firearm 50 which in one form is a 50 caliber BMG machine gun. Of course other types of firearms and equipment can be mounted thereto. As further shown in FIG. 5*a*, a control center 52 is provided. A control center 52 has the effective shifting the center of gravity of the boat forward.

It is important to note that without maintaining a minimum roll of the boat about the longitudinal axis during a high-speed turn (less than 200 roll with respect to the horizontal plane, less than 150 in any preferred form and less than 100 in a most preferred form). These turns can occur anywhere between 35–60 mph. In one range, these turns occur between 45 and 55 mph. One form of turning the boat is maintaining a full throttle at a high-speed. The turn diameter of the boat is approximately no more than three boat lengths in one form is less than 2½ boat lengths. In a most preferred embodiment the turn diameter is less than two boat lengths. It is desirable to maintain a minimum roll in order to operate the equipment on the boat that is necessary to maintain visual contact on the side of the boat with the lateral portion that is raised vertically in a turn. Of course the lateral G-forces with such a sharp fast turn can be very high. It has been estimated that the lateral G-forces has or can exceed two Gs in the lateral direction. In a broader scope, the lateral G's exceed 1–1.5 G's in the lateral direction during a high-speed turn. It should be noted that because the boat remains substantially flat during these high-speed turns, it is advisable that the passengers and the driver are buckled down in some form. Prior art boats tend to excessively roll (roll>20°–15° with respect to the horizontal plane in a high-speed turn) which in many environments is a desirable feature because the net thrust combining the vertical force of gravity and the lateral centrifugal force produced by the acceleration of the turn is at a downward and outward angle from the center of curvature of the turn. Therefore, having an excessive roll is desirable because the fixtures of the boat such as the seats and flooring are substantially perpendicular to the net thrust. In other words, the passengers and drivers merely feel more force upon the seats and flooring but not a lateral force with respect to the boat that knocks them off-balance and in some cases throws them clean off the boat.

As shown in FIG. 6 there is a table where the environment that the fin is placed in is shown with respect to various dimensions of the fin that extend vertically downwardly along the negative Y-axis. With the first column entitled "Length", there is shown the result of general hypothesis of altering the various dimensions in a qualitative manner. The dimension "A" in one form may increase with respect to a longer boat; however, it has been found that maintaining it at constant distance would be between 3–12 and more preferably between 4 to 10 inches, in a more preferred form between 5 to 9 inches. This dimension is from the rear-most portion of the transom the longitudinally rearward portion 11 to the upper most aft portion of the fin at the rearward effective portion 49. With respect to the second column entitled, "Weight", most of the parameters will remain constant whether lowering or increasing the weight with exception to the depth V would slightly increase with respect to a greater weight imparted upon the vessel. Now looking at the third column where the center of gravity is shown with respect to the fin parameters, as the center of gravity is aft (rearward) the dimension A may stay the same or decrease slightly. Further, as the center of gravity is positioned aft the dimension B will increase in the overall length of the fin.

Further as the center of gravity goes aft, the 'D' or depth of the fin will decrease. On the converse, as the center of gravity goes forward, the dimension 'D' will increase and extend deeper into the water. It is theorized that having this deeper insertion in the water is necessary to grab more water during maneuvers where it would be necessary to have a greater dimension.

With respect to speed, if the speed increases it is theorized that parameter A would increase thereby creating a larger gap region in the aft region of the boat. Further, it is theorized in this increase of speed that the overall length B would decrease and the depth of the fin D would decrease as well. When there is a high rate of speed of the boat with respect to the water, it is thought that less lift is required whereby the above-mentioned dimensions will affect accordingly the amount of lift.

Now referring to the fifth column referred to as the horse power of the vessel, it should first noted as a preliminary matter that in general when horse power increases there is cross over effect of the previous three parameters whereby the speed will have a tendency to increase in corners, the center of gravity will shift aft and the weight will increase. As shown in FIG. 6, there tends to be a canceling effect to some degree where the speed increases which causes A to increase and the center of gravity is aft which has a tendency for A to decrease, there is a quasi canceling effect whereby increase in the horse will remain a substantially constant dimension A. This is similar for dimension B with a like type of canceling effect. However, it has been found with respect to dimension D, as the horsepower goes up, the net effect is having a smaller value D. This has essentially "two for, one against" effect where the speed increase will have a tendency to decrease the parameter D and with an aft center gravity will decrease the value D. However, an increase of net weight will have a slight tendency to increase the value of D but the net effect is to decrease the dimension D as horse power increases.

With respect to the turning radius, this is further a function of the horsepower of the boat to some extent. However, usually a tighter training radius is a desired result of the watercraft and the fin system. In general to obtain a tighter turn with higher horsepower the parameter A is increased which has been found to have a tendency to reduce the amount of aerated water entering the propeller. Further, it has been found that shortening the dimension B has an advantageous effect as well. Finally, decreasing the depth D of the fin has an effect of aiding and reducing the turning radius. It should be reiterated that the tight turning radius is generally a desired goal of the watercraft. This is generally a function of the horsepower of the watercraft. On the right hand portion of FIG. 6, it is theorized that with sponsons positioned on a lateral portion of the boat there is a tendency to have greater lift which would increase the length of D. Further, for result of having bad water, if there is less bad water which is a good condition the parameter A is generally increased to accommodate this. For example, if there is a problem with having bad water entering the props increasing the parameter of A would generally assist in preventing "bad" water or aerated water. Further, if bad water is occurring, parameter D would decrease thereby assisting the creation of good water which is fed to the props. It should be noted that all these qualitative factors of increasing and decreasing are generally reactive to an existing type based design where adjusting various the parameter is executed to create a good boat that has a proper flat tracking roll about corners.

It is theorized that the extensions need the support of the hull to maintain rigidity because of the extreme force placed on the fins. It should be noted that an area of influence which is defined as the rearward ⅓ longitudinal distance of the boat is a desired location of the extension. Therefore, the forward most and rearward longitudinal most portion of the fin will be positioned within this ⅓ area in the aft portion of the boat. Therefore, an effective area of the fin is defined as a substantial length D value which engages the fluid for desired turning effects of maintaining a flat track. It should be noted that the depth value D and the length B help define the effective area of the fin. The effective area is defined as a substantial surface area to engage water for the hydrodynamic effects to induce flat tracking (i.e. longitudinal rate <20 degrees into broad scope or <15 degrees in a preferred scope and <10 degrees in the most preferred form). Of course it is obvious that various embodiments could slightly deviate at various longitudinal positions to be outside the ranges described below. However, where the effective area is substantially within the ranges described below is here in covered as and defined as the effective area. In essence, the position of the fin is within about the ⅓ longitudinal location of the boat in the aft portion. It should be noted that another way of parameterizing the results that a deep fin causes as well as a flat track which is generally between 5 to 20 degrees in a broad range with a respectable amount of lateral G force such as 0.5–2.5 lateral G's. Further the amount of G's the fin system allows to produce is anywhere between as mentioned 0.5–2.6 Gs laterally. When the boat is remained substantially flat about the longitudinal axis with the high G's there is an extreme amount of acceleration felt upon the passengers and driver. Therefore, as mentioned above, it is advised that the passengers and driver are buckled into the vessel in some sort. The lower horsepower you would need the depth of D with a fin because the boat isn't lifting on plane as high so the influence must be deeper. With the high horse power such as 500-horsepower, a three inch would be an estimated maximum because the hook would be too great.

Now referring to FIGS. 7–14, it is generally shown ranges of dimensions that has been found and are theorized to provide desirable results of flat tracking during high-speed cornering. In general, each of the combinations of FIGS. 7–8, 9–10, 11–12, and 13–14 disclose upper and lower ranges for various parameters at different boat lengths. In general the vertical axis in the graphs shown in FIGS. 7–14 indicates the ranges of the dimensions in inches. The laterally extending axis indicates various gross weights of the boat's where the fins stabilization system is applied thereon. The depth axis sliding off at an angle indicates the horsepower of thrust of the boat's engine. As described above, in general there is a spillover effect of the horsepower and other parameters such as weight, position of the center of gravity in the longitudinal direction and speed. Therefore for simplicity in showing the arrangement of relationships for the dimensions of the fin control system 21 with respect to the parameters of the boat and performance, horsepower is shown to generally indicate the dimension/parameter relationships.

Figure 7:
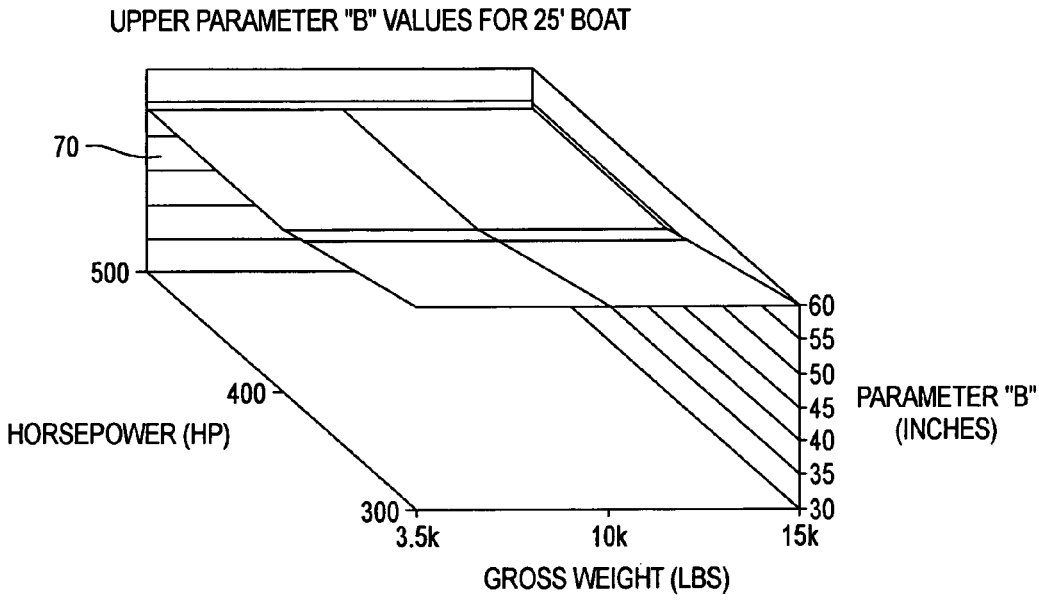
FIG. 7 shows a three-dimensional graph for the upper perimeter distance variable for the "B" dimension with respects to Power and Gross Weight for a 25 ft. boat.
Figure 8:
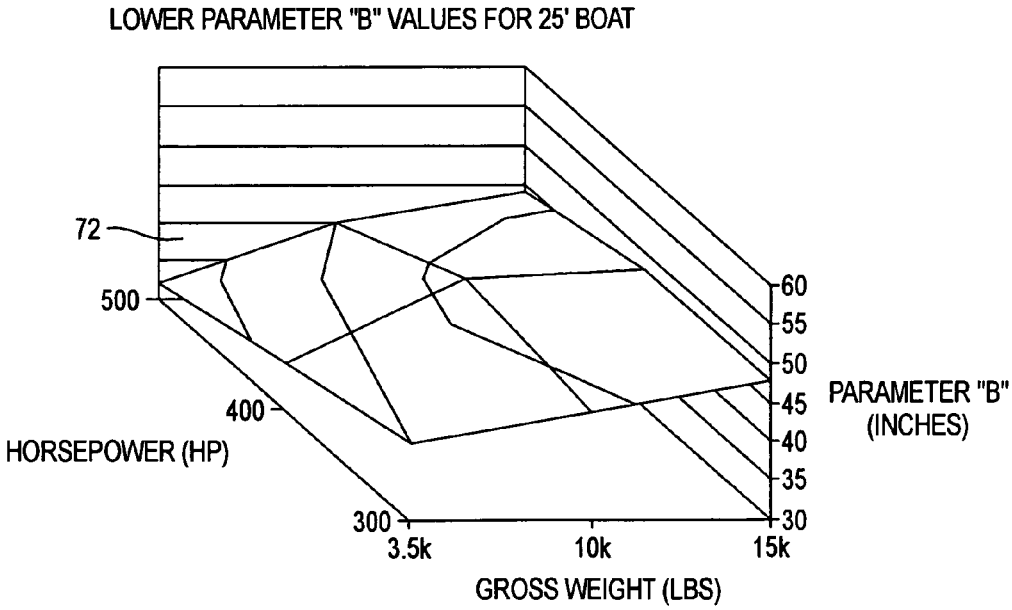
FIG. 8 shows a three-dimensional graph for the lower perimeter distance variable for the "B" dimension with respects to Power and Gross Weight for a 25 ft. boat.

Referring to FIGS. 7–8, there is shown parameter values for the dimension "B" that is shown in FIG. 2. FIGS. 7 and 8 relate to parameter value B for a 25 ft. boat. FIG. 7 indicates an upper range 70 that is hypothesized or tested empirically for an upper range of an overall length of the fins 40 and 42. It should be noted that a lower horsepower boat (e.g. 300 horsepower) tends to increase the length of the fins 40 and 42. It should be noted that the values in the graphs as shown in FIG. 7 are general estimates; however, it is further theorized that having values of "A" and "B" that in combination position the fin control system 21 and the rearward one third portion of the boat would function properly in the broader scope of the disclosure.

| | Weight | | |
|---|---|---|---|
| Horsepower | 3.5 k | 10 k | 15 k |
| 300 | 60" | 60" | 60" |
| 400 | 54" | 54" | 54" |
| 500 | 54" | 54" | 54" |

FIG. 8 shows the lower ranges indicated at 72 that are theorized and found empirically to give proper results for the fin control system attached to a boat. It can be seen in the left-hand portion of FIG. 8 that a high horsepower low weight boat can have a lower minimum value (be shorter) than a heavy little horsepower boat which would require a relatively higher minimum value. FIG. 8 further discloses that in general, decreasing the horsepower of the boat tends to have a larger minimum value for the parameter B. Further, looking at the gross weight in isolation indicates that increasing the gross weight tends to increase the minimum workable value of the parameter B for desired results. The data for the values as shown in FIG. 8 are shown below.

| | Weight | | |
|---|---|---|---|
| Horsepower | 3.5 k | 10 k | 15 k |
| 300 | 40" | 44" | 48" |
| 400 | 36" | 47" | 48" |
| 500 | 32" | 40" | 44" |

Figure 9:
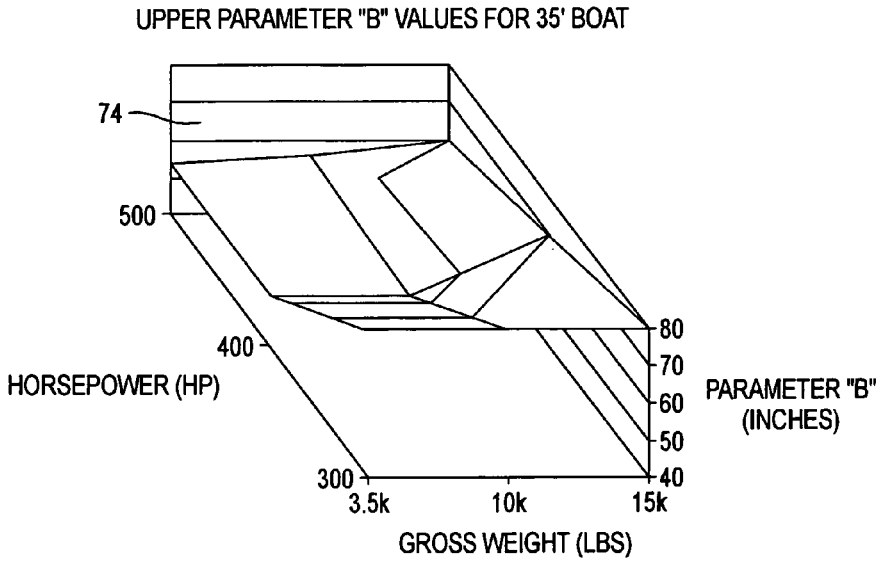
FIG. 9 shows a three-dimensional graph for the upper perimeter distance variable for the "B" dimension with respects to Power and Gross Weight for a 35 ft. boat.
Figure 10:
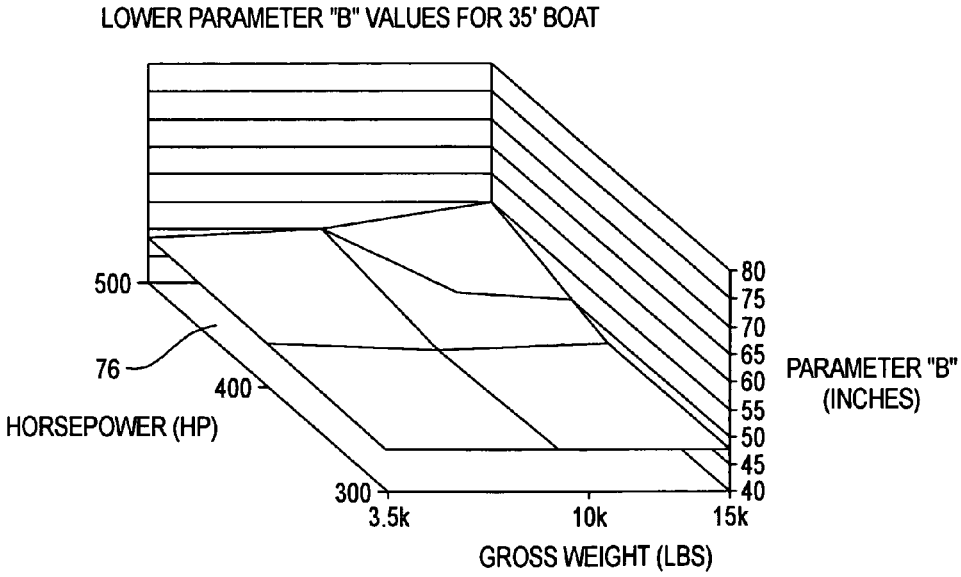
FIG. 10 shows a three-dimensional graph for the lower perimeter distance variable for the "B" dimension with respects to Power and Gross Weight for a 35 ft. boat.

Now referring to FIGS. 9–10, there is shown parameter values for the "B" parameter for 36 ft. boat. FIG. 9 shows the upper range value in FIG. 10 shows a lower range value based upon empirical and theoretical analysis.

As shown in FIG. 9, the longitudinal length "B" of the fins 40 and 42 generally tend to increase in maximum desired length as the horsepower decreases as shown by the graph surface 74. It has been found that with a higher horsepower boat the high-speed turns generally are faster whereby the reaction forces by the water is greater and a relatively shorter fin is only required to prevent excessive roll and promote flat tracking. The FIG. 9 data is listed below as:

| | Weight | | |
|---|---|---|---|
| Horsepower | 3.5 k | 10 k | 15 k |
| 300 | 80" | 80" | 80" |
| 400 | 54" | 54" | 70" |
| 500 | 54" | 56" | 60" |

Now referring to FIG. 10, the graph surface 76 shows the minimum suggested values for the length of the fins 40 and 42, in the upper right hand corner indicating a high horsepower and high gross weight, it is theorize that a longer fin may be necessary because the speed may not be as great and the centrifugal force of the load is such that a longer fin may be necessary to promote flat tracking. The FIG. 10 data is listed below as:

| | Weight | | |
|---|---|---|---|
| Horsepower | 3.5 k | 10 k | 15 k |
| 300 | 48" | 48" | 48" |
| 400 | 48" | 47" | 48" |
| 500 | 48" | 50" | 55" |

The following graphs in FIGS. 11–14 are similar to that of FIGS. 7–10 except the latter figures delayed two the parameter "D" which is best seen in FIG. 2. It is been found that providing a rearward gap region which is defined by the distance parameter "D" which is defined above, is very beneficial for allowing nonaerated water (clean water) to enter the props which is very desirable particularly in high-performance mission-critical boating.

Figure 11:
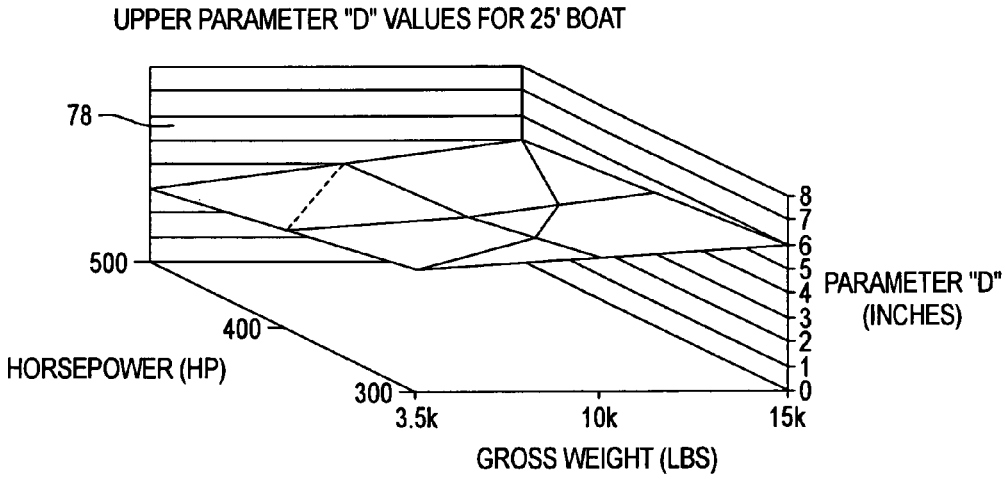
FIG. 11 shows a three-dimensional graph for the upper perimeter distance variable for the "D" dimension with respects to Power and Gross Weight for a 25 ft. boat.

As shown in FIG. 11, the graph surface 78 generally indicates that as the weight increases and/or the horsepower decreases, the upper range of the distance parameter "D" increases. The FIG. 11 data is listed below as:

| | Weight | | |
|---|---|---|---|
| Horsepower | 3.5 k | 10 k | 15 k |
| 300 | 5" | 5.5" | 6" |
| 400 | 4" | 4.5" | 5.5" |
| 500 | 3" | 4" | 5" |

Figure 12:
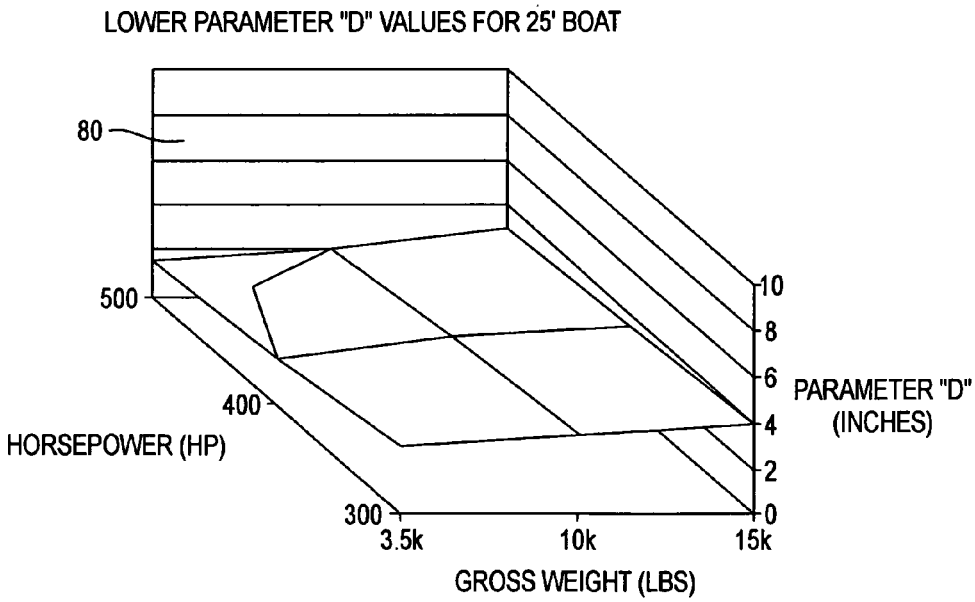
FIG. 12 shows a three-dimensional graph for the upper perimeter distance variable for the "D" dimension with respects to Power and Gross Weight for a 25 ft. boat.

As shown in FIG. 12 the graph surface 80 has a similar type of relationship indicating the lower values for the distance parameter "D". The FIG. 12 data is listed below as:

| | Weight | | |
|---|---|---|---|
| Horsepower | 3.5 k | 10 k | 15 k |
| 300 | 3" | 3.5" | 4" |
| 400 | 2" | 3" | 3.5" |
| 500 | 1.5" | 2" | 3" |

Figure 13:
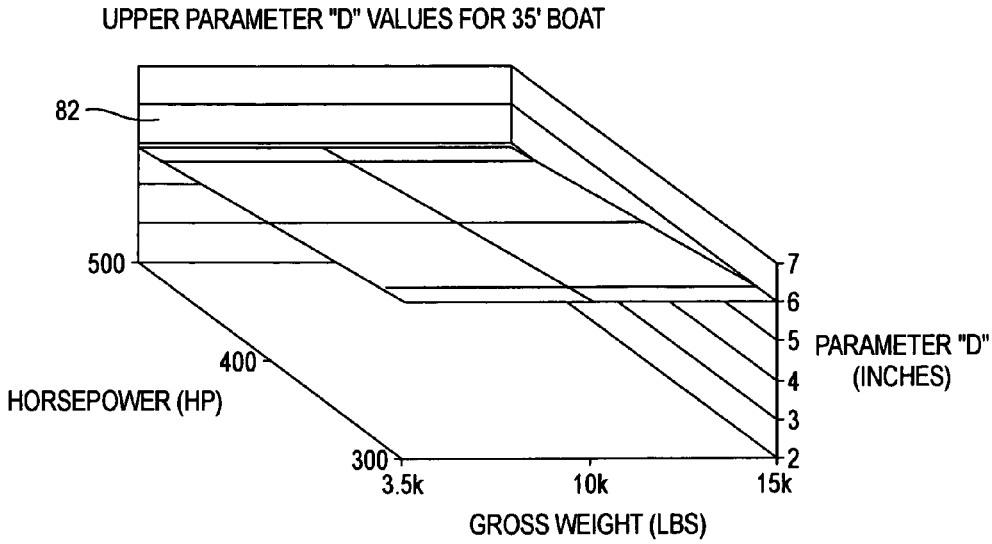
FIG. 13 shows a three-dimensional graph for the upper perimeter distance variable for the T" dimension with respects to Power and Gross Weight for a 35 ft. boat.
Figure 14:
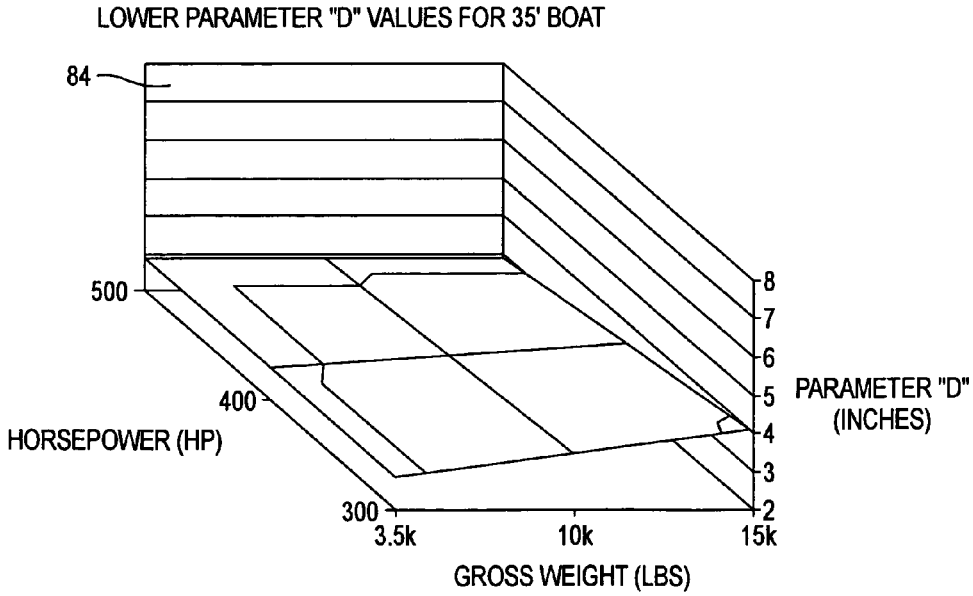
FIG. 14 shows a three-dimensional graph for the lower perimeter distance variable for the "D" dimension with respects to Power and Gross Weight for a 35 ft. boat.

Now reference is made to the graphs as shown in FIGS. 13 and 14 which indicate the distance parameter "D" for 35 ft. boat with respect to horsepower and gross weight. As shown in FIG. 13, the graph surface 82 indicates that the upper distance parameter "D" is substantially less dependent upon the gross weight and more of a function of the horsepower whereby an increase in horsepower only requires a smaller distance parameter "D". The FIG. 13 data is listed below as:

| | Weight | | |
|---|---|---|---|
| Horsepower | 3.5 k | 10 k | 15 k |
| 300 | 6.1" | 6.1" | 6.1" |
| 400 | 5.5" | 5.5" | 5.5" |
| 500 | 4.9" | 4.9" | 4.9" |

Now referring to the surface 84 in FIG. 14, it is shown that a minimum recommendation of about four inches is necessary for a very heavy gross weight of 15,000 lbs. and a very low powered engine of about 300 horsepower for a very long boat of 35 ft. The FIG. 14 data is listed below as:

| | Weight | | |
|---|---|---|---|
| Horsepower | 3.5 k | 10 k | 15 k |
| 300 | 2.9" | 3.5" | 4.1" |
| 400 | 2.9" | 3.25" | 3.5" |
| 500 | 2.9" | 2.9" | 2.9" |

It should be noted that the graphs and parameters are partially based upon empirical data that was acquired over many months of testing and theoretical analysis based upon the data and the general knowledge of fluid dynamics of the inventors. It should be noted that the ranges as shown in FIGS. 7–14 are general suggestions and where numerically possible (i.e. not going to negative values) can be expanded by an estimated 20%–40% in the broader scope. It should be further noted that it is theorize that as shown in FIG. 1, the area of influence of the boat has a longitudinal and lateral dimension where the longitudinal distance 86 roughly corresponds to the rearward one third length of the boat. As shown in FIG. 3, the dimension in the lateral direction indicated at 88 indicates a lateral area of influence which is approximately one third of the latterly outward portion of the boat with respect to the outer portion of the boat to the centerline of the boat.

It is evident that various modifications could be made of the present invention without departing from the basic teachings thereof.

We claim:

1. A fin stabilization system adapted to be mounted to the area of influence of a boat which consists of the longitudinal rearward laterally outward one-third section of the boat having a longitudinal, lateral and vertical axis, the fin stabilization system comprising:

a) a first fin and a second fin positioned in the area of influence of a boat having a rearward effective portion and a forward effect of portion and a depth whereby the first and second fins are parameterized where each are positioned to according to the following ranges:

i. a rear base distance from the longitudinally rearward portion of the boat to the rearward effective portion between the ranges of 5 in.–12 in., ii. having the distance between the rearward effective portion and the forward effective portion of no more than 70 in., iii. having a depth component that is less than 6 in., b) whereby the fin stabilization system is adapted to maintain the roll of the boat about the longitudinal axis of no more than 20° from a horizontal plane in a turn in excess of speeds of 35 mph of the boat and the first and second fins are attached to a first and second mounting brackets each having a base region and a mounting extension whereby the base region is rigidly mounted to the lateral portion of the hull and the first and second fins are mounted to the mounting extensions of the first and second mounting brackets respectively.

2. The fin stabilization system as recited in claim 1 whereby the first and second fins are mounted to the mounting extensions of the first and second mounting brackets respectively whereby the mounting elements are flush with the surfaces of the first and second fins.

3. The fin stabilization system as recited in claim 1 whereby the roll of the boat is no more than 15° in a turn in speeds in excess of 35 mph.

4. The fin stabilization system as recited in claim 1 whereby the roll of the boat is no more than 15° in a turn in speeds in excess of 40 mph.

5. The fin stabilization system as recited in claim 4 whereby the longitudinal length of the boat is between 18 and 32 ft. by the depth component of the first and second fins is less than 4.5 in.

6. The fin stabilization system as recited in claim 5 whereby the turn diameter of the boat is no more than three boat lengths.

7. The fin stabilization system as recited in claim 5 whereby the turn diameter of the boat is no more than two boat lengths.

8. The fin stabilization system as recited in claim 4 whereby the turn diameter of the boat is no more than three boat lengths.

9. The fin stabilization system as recited in claim 4 whereby the turn diameter of the boat is no more than two boat lengths.

10. The fin stabilization system as recited in claim 1 whereby the hull of the boat is a planing hull.

11. The fin stabilization system as recited in claim 1 whereby the boat comprises a metal multi-chambered perimeter hull portion having two side hull portions which are on opposite sides of the central hull portion, and which have forward perimeter hull portions converging toward one another at a forward end portion of the boat hull and said perimeter hull portion comprising:

a) a plurality of multi-creased wall sections, each of which has a lengthwise axis, and each formed from a related metal sheet in a surrounding wall configuration by being bent along a plurality of generally lengthwise creases, with wall section portions extending 5 between adjacent pairs of said creases;

b) said multi-creased wall sections each having end perimeter edge portions with adjacent end perimeter edge portions of adjacent multi-chambered wall sections being adjacent to one another in end-to-end relationship at a perimeter juncture location;

c) a plurality of baffles, with each baffle being positioned at a related perimeter juncture location, with a perimeter edge of the baffle being adjacent to the end perimeter edge portions of adjacent multi chambered wall sections, and with the adjacent end perimeter edge portions and the perimeter edge of the adjacent baffle being welded together to form a watertight seal, and with the adjacent baffle making an air seal between interior regions of adjacent multi chambered wall sections;

d) said multi-chambered wall sections and said baffles thus being joined together to provide a plurality of airtight floatation chambers, with each chamber being enclosed by a related wall section and two related end baffles, with weld connections at the related end baffles forming an airtight connection.

12. The fin stabilization system as recited in claim 1 whereby the fin stabilization system is adapted to raise the laterally outward fin in a turn out of the water and the laterally inward fin in a turn is submerged in the water.

13. The fin stabilization system as recited in claim 12 whereby the boat has an engine that is operatively attached to a propeller and in a turn the propeller receives water with the lower concentration of air than without the fin stabilization system during a turn greater than 35 mph.

14. The fin stabilization system as recited in claim 13 whereby the roll about the longitudinal axis is less than 15° at a speed in excess of a 40 ml.-per-hour turn.

15. The fin stabilization system as recited in claim 13 whereby the roll about the longitudinal axis is less than 10° at a speed in excess of a 45 ml.-per-hour turn.

16. The fin stabilization system as described in claim 15 whereby the turn is conducted where the engine is under full throttle for the entirety of the turn.

17. The fin stabilization system as described in claim 13 whereby the turn diameter is less than 2½ boat length for a 180-degree turn.

18. The fin stabilization system as described in claim 1 whereby a firearm is adapted to be mounted to the bow of the boat.

19. The fin stabilization system as recited in claim 1 whereby the boat is adapted to make a turn creating a G-force in the horizontal direction that is in excess of 1.0.

20. The fin stabilization system as recited in claim 1 whereby the boat is adapted to make a turn creating a G-force in the horizontal direction that is in excess of 1.5.

21. The fin stabilization system as recited in claim 1 whereby the boat is adapted to make a turn creating a G-force in the horizontal direction that is in excess of 2.0.

22. The fin stabilization system as recited in claim 1 whereby the boat is between 17 ft. and 35 ft. in longitudinal length.

23. The fin stabilization system as recited in claim 1 whereby the boat length is between 20 ft. and 32 ft. and longitudinal length.

24. A fin stabilization system adapted to be mounted to the area of influence of a boat positioned on the longitudinal rearward laterally outward one third section of the boat having a longitudinal, lateral and a vertical axis, the fin stabilization system comprising:

a) a first fin and the second fin positioned in the area of influence of a boat having a rearward effective portion and a forward effect of portion and a depth whereby the first and second fins are parameterized where each are positioned to according to the following ranges, i. a rear base distance from the longitudinally rearward portion of the boat to the rearward effective portion between the ranges of 5 in.–12 in., ii. having the forward effective portion positioned in the area of influence of the boat, iii. having a depth component that is less than 6 in., b) whereby the fin stabilization system is adapted to maintain the roll of the boat about the longitudinal axis of no more than 20° from a horizontal plane in a turn in excess of speeds of 35 mph of the boat whereby the turn diameter of the boat is no more than three boat lengths and whereby the first and second fins are attached to a first and second mounting brackets each having a base region and a mounting extension whereby the base region is rigidly mounted to the lateral portion of the hull and the first and second fins are mounted to the mounting extensions of the first and second mounting brackets respectively.

25. The fin stabilization system as recited in claim 24 whereby the first and second fins are mounted to the mounting extensions of the first and second mounting brackets respectively whereby the mounting elements are flush with the surfaces of the first and second fins.

26. The fin stabilization system as recited in claim 24 whereby the roll of the boat is no more than 15° in a turn in speeds in excess of 35 mph.

27. The fin stabilization system as recited in claim 24 whereby the roll of the boat is no more than 15° in a turn in speeds in excess of 40 mph.

28. The fin stabilization system as recited in claim 27 whereby the longitudinal length of the boat is between 18 and 32 ft. whereby the depth component of the first and second fins is less than 4.5 inches.

29. The fin stabilization system as recited in claim 28 whereby the turn diameter of the boat is no more than three boat lengths.

30. The fin stabilization system as recited in claim 28 whereby the turn diameter of the boat is no more than two boat lengths.

31. The fin stabilization system as recited in claim 27 whereby the turn diameter of the boat is no more than two and a half boat lengths.

32. The fin stabilization system as recited in claim 27 whereby the turn diameter of the boat is no more than two boat lengths.

33. The fin stabilization system as recited in claim 24 whereby the hull of the boat is a planing hull.

34. The fin stabilization system as recited in claim 24 whereby the boat comprises a metal multi-chambered perimeter hull portion having two side hull portions which are on opposite sides of the central hull portion, and which have forward perimeter hull portions converging toward one another at a forward end portion of the boat hull and said perimeter hull portion comprising:

a) a plurality of multi-creased wall sections, each of which has a lengthwise axis, and each formed from a related metal sheet in a surrounding wall configuration by being bent along a plurality of generally lengthwise creases, with wall section portions extending between adjacent pairs of said creases;

b) said multi-creased wall sections each having end perimeter edge portions with adjacent end perimeter edge portions of adjacent multi-chambered wall sections being adjacent to one another in end-to-end relationship at a perimeter juncture location;

c) a plurality of baffles, with each baffle being positioned at a related perimeter juncture location, with a perimeter edge of the baffle being adjacent to the end perimeter edge portions of adjacent multi chambered wall sections, and with the adjacent end perimeter edge portions and the perimeter edge of the adjacent baffle being welded together to form a watertight seal, and with the adjacent baffle making an air seal between interior regions of adjacent multichambered wall sections;

d) said multi-chambered wall sections and said baffles thus being joined together to provide a plurality of airtight floatation chambers, with each chamber being enclosed by a related wall section and two related end baffles, with weld connections at the related end baffles forming an airtight connection.

35. The fin stabilization system as recited in claim 24 whereby the fin stabilization system is adapted to raise the laterally outward fin in a turn out of the water and the laterally inward fin in a turn is submerged in the water.

36. The fin stabilization system as recited in claim 35 whereby the boat has an engine that is operatively attached to a propeller and in a turn the propeller receives water with the lower concentration of air than without the fin stabilization system during a turn greater than 35 mph.

37. The fin stabilization system as recited in claim 36 whereby the roll about the longitudinal axis is less than 15° at a speed in excess of a 40 ml.-per-hour turn.

38. The fin stabilization system as recited in claim 36 whereby the roll about the longitudinal axis is less than 10° at a speed in excess of a 45 ml.-per-hour turn.

39. The fin stabilization system as described in claim 38 whereby the turn diameter is less than 2½ boat length for a 180-degree turn.

40. The fin stabilization system as described in claim 39 whereby the turn is conducted where the engine is under full throttle for the entirety of the turn.

41. The fin stabilization system as described in claim 24 whereby a firearm is adapted to be mounted to the bow of the boat.

42. The fin stabilization system as recited in claim 24 whereby the boat is adapted to make a turn creating a G-force in the horizontal direction that is in excess of 1.0.

43. The fin stabilization system as recited in claim 24 whereby the boat is adapted to make a turn creating a G-force in the horizontal direction that is in excess of 1.5.

44. The fin stabilization system as recited in claim 24 whereby the boat is adapted to make a turn creating a G-force in the horizontal direction that is in excess of 2.0.

45. The fin stabilization system as recited in claim 24 whereby the boat is between 17 ft. and 35 ft. in longitudinal length.

46. The fin stabilization system as recited in claim 24 whereby the boat length is between 20 ft. and 32 ft. and longitudinal length.

* * * * *